United States Patent [19]

Steger

[11] Patent Number: 4,947,588

[45] Date of Patent: Aug. 14, 1990

[54] GRINDING TOOL

[75] Inventor: Johann Steger, Brunico, Italy

[73] Assignee: Birfield Trasmissioni S.p.A., Italy

[21] Appl. No.: 72,548

[22] Filed: Jul. 13, 1987

[30] Foreign Application Priority Data

Jul. 11, 1986 [DE] Fed. Rep. of Germany ..... 3623408

[51] Int. Cl.[5] ..... B24D 7/00

[52] U.S. Cl. ..... 51/206 R

[58] Field of Search ..... 51/206 R, 206.4, 206 P

[56] References Cited

U.S. PATENT DOCUMENTS

| | | | |
|---|---|---|---|
| 283,832 | 8/1883 | Thayer | 51/206 R |
| 3,510,990 | 5/1970 | Steindler | 51/206 R |
| 3,972,161 | 8/1976 | Zoiss | 51/206 R |
| 4,110,085 | 8/1978 | Baly | 51/308 |
| 4,157,897 | 6/1979 | Keat | 51/295 |
| 4,494,964 | 1/1985 | Ohlasson | 51/296 |
| 4,558,540 | 12/1985 | Collins | 51/214 |
| 4,574,003 | 3/1986 | Gerk | 51/296 |
| 4,634,453 | 1/1987 | Hoy et al. | 51/295 |
| 4,635,407 | 1/1987 | Pacini | 51/206 R |
| 4,661,064 | 4/1987 | Beltramini | 51/206 P |
| 4,787,362 | 11/1988 | Boucher | 51/295 |

FOREIGN PATENT DOCUMENTS

| | | |
|---|---|---|
| 541393 | 5/1965 | Switzerland . |
| 1075998 | 3/1971 | United Kingdom . |
| 1080155 | 10/1971 | United Kingdom . |

*Primary Examiner*—Frederick R. Schmidt
*Assistant Examiner*—Blynn Shideler
*Attorney, Agent, or Firm*—Toren, McGeady & Associates

[57] ABSTRACT

A grinding tool, for attachment to a grinding tool carrier in a grinding machine, comprises a core member (3) which is provided with means such as a central bolt (5) for attachment to a tool carrier (6), and has at least two segments (21) of grinding material disposed circumferentially about and permanently fixed by an adhesive to the core member, grooves being defined between the segments of grinding material. The core member with segments of grinding material is easily replaced without replacing the tool carrier.

6 Claims, 1 Drawing Sheet

GRINDING TOOL

BACKGROUND OF THE INVENTION

1. Field of the Invention

This invention relates to a grinding tool, for attachment to a tool carrier in a grinding machine wherein the grinding tool is rotated about an axis in order to perform a grinding operation on a workpiece.

Examples of operations for which such grinding tools are used are the grinding of ball tracks in constant velocity ratio universal joints, or the cage windows in such joints. Grinding machines used for such operations are operated possibly at speeds of over 40,000 rpm.

2. Description of Prior Art

In DE-OS No. 3144810, an adjustable grinding tool is disclosed wherein the grinding member comprises a metal sleeve having a galvanically applied coating of grinding grains. The sleeve is expansible for adjustment of the effective size of the tool.

U.S. Pat. No. 2,302,207 discloses a honing tool having two adjustable segments of grinding material, of circular cross-section, fixed to metal plates and together adjustably attached to a tool carrier. This adjustment mechanism is a relatively complicated mechanical system.

Further, grinding tools are known which are designed in one part, the actual grinding member being permanently fixed rigidly to the grinding tool carrier. When the grinding member is worn, such a tool has to be replaced in its entirety. Further, the grinding member has to be dressed by means of a trueing device to ensure that it runs concentrically.

SUMMARY OF THE INVENTION

It is the object of the present invention to provide a grinding tool such that the grinding member subject to wear can easily be replaced, while the tool carrier is re-used, the grinding member being easily fitted and able to be produced economically.

According to the present invention, we provide a grinding tool for attachment to a grinding tool carrier in a grinding machine, for rotation about an axis, comprising a core member having means for attachment to the tool carrier, and at least two segments of grinding material disposed circumferentially about and permanently fixed by an adhesive to the core member and defining grooves therebetween. Preferably the means for attachment of the core member to the tool carrier comprises a central bolt permanently fixed thereto.

In the grinding tool according to the invention, costs are reduced because only the segments are required to be made of the grinding material, such as a ceramically bonded grinding material such as cubic boron nitride. Furthermore, the grooves between the segments provide socalled "chip chambers" which provide cooler grinding conditions thereby achieving an improvement in the quality of the workpiece being ground. In addition, the power required to drive a grinding tool according to the invention is lower than with prior art grinding tools, so that energy consumption during a grinding operation is lower.

In an advantageous embodiment of the invention, the core member to which the segments are fixed comprises trueable corundum, ceramics, or like material, thereby ensuring great dimensional accuracy. Furthermore, it is possible to design a core member of such material in such a way that it is completely or partially hollow, or has a continuous bore extending through it, and to reduce the wall thickness of the segments secured to the core member. In turn this means a saving in the cost of the effective grinding material.

Suitable adhesives for securing the segments of grinding material to the core member comprise glues of single or double component type, curing by chemical reaction either cold or hot.

It is advantageous for the segments secured to the core member to be identical to one another, i.e. having the same material structure and size as one another. In one preferred embodiment of the invention, three segments are disposed around the circumference of the core member equally spaced from one another. Each segment is preferably in the form of part of a hollow cylinder, which enables segments to be produced from a tubular member by dividing it by axial separating cuts. However, it would also be possible to produce segments directly in the required shape.

In a preferred embodiment, the segments are flush with an end face of the core member.

The segments of grinding material may together cover approximately 180 degrees to 355 degrees of the circumference of the grinding member, preferably 240 degrees to 355 degrees, with the remainder of the circumference occupied by the grooves between the segments. The circumferential extent of a groove between each two segments may be approximately 5 degrees to 50 degrees, preferably 5 degrees to 35 degrees. The more segments there are, the greater the extent of the groove relative to the extent of each segment may be.

In a preferred embodiment of grinding tool, three segments each extending around approximately 90 degrees of the circumference of the grinding member are secured to the core member with equal distances between them. Such segments may be produced from a round or tubular member of the grinding material, by dividing it by axial separating cuts of small width (approximately 1 mm). Three of the four segments thus obtained are used to make one grinding tool, whilst the fourth segment is used for a further grinding tool to be manufactured.

The segments may each be tapered at one end, which end is at the end of the tool remote from its attachment bolt. By way of example, typical segments may have an outside diameter of approximately 13 to 23 mm, an axial length of approximately 20 to 30 mm, and a wall thickness of approximately 3 to 5 mm.

To increase the security of connection between the segments and the core member, the circumference of the core member may be provided with a number of pockets or recesses wherein the segments are fixed, the recesses extending from an end face of the core member and having a radial depth less than the wall thickness of the segments.

It is also possible to provide the core member with a central finger which has a diameter reduced, compared with the outside diameter of the core member, by a maximum of twice the thickness of a segment. The segments may then be supported, through recesses in the core member, on the central finger, which may be stepped to provide a supporting shoulder for the segments.

For securing it to the tool carrier, the core member provided with the segments may have a central bolt permanently fixed in a central blind hole in the core member. Such a bolt may be fixed to the core member, by gluing, pressing, casting, or otherwise embedding it in the core member. Secured to the grinding tool by such a bolt, the tool carrier may then be attached to the spindle of a grinding machine. If the grinding member is worn, only the core member carrying the segments of grinding material has to be replaced.

BRIEF DESCRIPTION OF DRAWINGS

The invention will now be described by way of example with reference to the accompanying drawings, of which.

DESCRIPTION OF PREFERRED EMBODIMENTS

Figure 1:
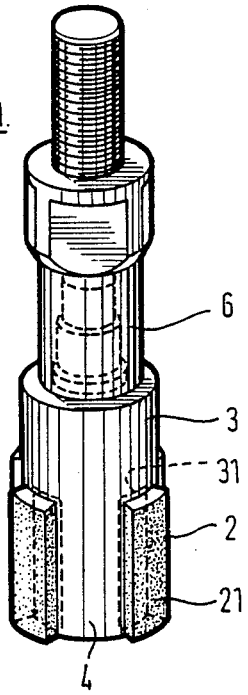
FIG. 1 is a perspective view of an assembly of a grinding tool and tool carrier.

Referring firstly to FIG. 1 of the drawings, the assembly there illustrated comprises a grinding tool 2 secured to a tool carrier 6. The grinding tool 2 comprises a core member 3 to which are secured four circumferentially spaced segments 21 of grinding material.

Figure 2:
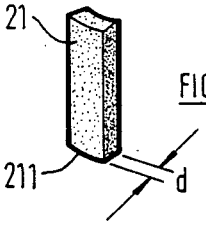
FIG. 2 is a perspective view of a segment of grinding material.
Figure 3:
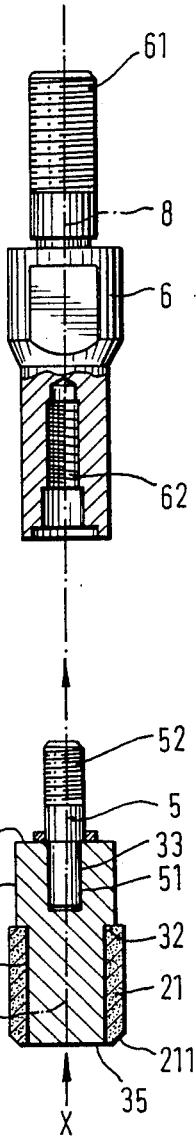
FIG. 3 is a exploded view, in section, of the tool assembly of FIG. 1.

With reference now additionally to FIGS. 2 and 3, the core member 3 is provided with circumferentially spaced recesses or pockets 31 in which the segments 21 of grinding material are received and permanently secured by use of a suitable adhesive. A segment 21 is shown in detail in FIG. 2; it is in the form of part of a hollow cylinder having a wall thickness d, and the radial depth of the recesses or pockets 31 in the core member 3 is less than the wall thickness d so that the segments 21 extend beyond the circumferential surface of the core member to define grooves 4 therebetween. The wall thickness d of a segment may be approximately 3 mm. The circumferential surface of the core member 3 is indicated at 34 in FIG. 3.

Each of the pockets or recesses 31 extends parallel to the axis of rotation 8 of the tool, from an end face 35 of the core member remote from the tool carrier 6 to a shoulder 32. When secured in position in such recesses, the ends of segments 21 abut the shoulder 32 and the opposite ends of the segments 21 lie flush with the end face 35, and such opposite end faces of the segments may be chamferred or tapered as shown at 211.

The core member 3 may be made of corundum or a ceramic material, and may be hollow.

Suitable adhesives for securing the segments of grinding material to the core member comprise glues of single or double component type, curing by chemical reaction either cold or hot.

The core member has a central blind hole 33 in which is received a central bolt 5 which provides means for attachment of the tool to the tool carrier 6. The bolt 5 is permanently fixed in the core member by being pressed therein, by use of an adhesive, or by other suitable means, and the bolt may be provided with a knurled region 51 to increase the strength of such connection. The free end of the bolt 5 has a thread 52 which engages in a threaded bore 62 in the tool carrier 6, and the core member 3 has an abutment surface 36 at its end facing the tool carrier 6 so that a rigid connection therebetween is achieved. At its opposite end, the tool carrier 6 has a threaded portion 61 to be removably connected to the spindle of a grinding machine.

Figure 4:
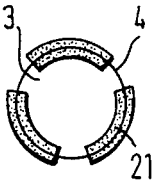
FIGS. 4 and 5 are views in the direction of arrow X in FIG. 3, of two embodiments of grinding tool according to the invention.
Figure 5:
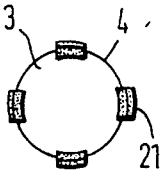

The relative circumferential extent of the segments 21 and the grooves therebetween may be as above referred to. In the embodiment of FIG. 4, three segments 21 are provided each subtending an angle of approximately 90 degrees at the axis of rotation 8 of the core member 3. The grooves 4 defined between the segments 21 each extend circumferentially so as to subtend approximately 30 degrees. In FIG. 5, there is shown an embodiment wherein four segments 21 are provided, with each groove 4 extending circumferentially for approximately the same distance as each segment.

I claim:

1. The combination of a grinding tool carrier for rotation about an axis in a grinding machine and having a threaded bore at one end thereof, with a disposable grinding tool comprising an axially extending core member consisting essentially of ceramic material and having a first end and a second end, a threaded bolt projecting centrally from said second end and being permanently embedded and fixed in the ceramic material of the core member at said second end, the threaded bolt being arranged to be received in the threaded bore in the tool carrier to attach the tool to the tool carrier, an abutment surface formed on said second end and surrounding the bolt for engaging the tool carrier when the tool is attached thereto, said core member having an axially extending outer circumferential surface and at least two preformed segments of a ceramically bonded grinding material each segment extending around approximately 90 degrees of the core member circumference with an equal distance between them, said core member having at least two abutments extending transversely of the axis of said core member and extending inwardly of the outer circumferential surface extending from the second end of said core member and spaced from the first end of said core member, each of said segments having a first end located in the plane of the first end of said core and a second end spaced in the axial direction of said core member from the first end and contacting one of said abutments, said segments being permanently fixed to the core member by an adhesive, said preformed segments projecting radially outwardly from the circumferential surface in the region of the first end of said core member and in combination with the circumferential surface forming grooves between circumferentially adjacent said segments.

2. A disposable grinding tool for attachment to a grinding tool carrier and a grinding machine, for rotation about an axis, the tool comprising an axially extending core member consisting essentially of ceramic material and having a first end and a second end, an axially extending threaded bolt projecting centrally from said second end for attachment of the tool to the tool carrier, one end of the bolt being permanently embedded and fixed in the ceramic material of the core member at said second end, an abutment member formed on said second end and surrounding said bolt for engaging the tool carrier when the tool is in use, said core member having an axially extending outer circumferential surface and at least two part-cylindrical preformed segments of a ceramically bonded grinding material, each segment extending around approximately 90 degrees of the core member circumference with an equal distance between them, said core member having at least two abutments extending transversely of the axis of said core member and extending inwardly of the outer circumferential surface extending from the second end of said core member and spaced from the first end of said core member, each of said segments having a first end located in the plane of the first end of said core and a second end spaced in the axial direction of said core member from the first end and contacting one of said abutments, said segments being permanently fixed to the core member by an adhesive, said segments projecting radially outwardly from the circumferential surface in the region of the first end of said core member and in combination with the circumferential surface forming grooves between circumferentially adjacent said segments.

3. A disposable grinding tool for attachment to a grinding tool carrier in a grinding machine for rotation about an axis, the tool comprising an axially extending cylindrically shaped core member consisting essentially of ceramic material and having a first end and a second end spaced apart in the axial direction, an axially extending threaded bolt projecting centrally from said second end for attachment of the tool to the tool carrier and spaced radially inwardly from the circumferential surface of said core member, one end of the bolt being permanently embedded and fixed in the ceramic material of the core member at said second end, an abutment surface formed on and extending transversely of the axis of said grinding tool at said second end and surrounding said bolt engaging the tool carrier when the tool is in use, said abutment surface extending radially outwardly from said threaded bolt, said core member having an axially extending cylindrically shaped outer circumferential surface and at least two partly cylindrical preformed segments of a ceramically bonded grinding material each segment extending around approximately 90 degrees of the core member circumference with an equal distance between them, said core member having at least two abutments extending transversely of the axis of said core member and extending inwardly of the outer circumferential surface extending from the second end of said core member and spaced from the first end of said core member, each of said segments having a first end located in the plane of the first end of said core and a second end spaced in the axial direction of said core member from the first end and contacting one of said abutments, said segments being permanently fixed to the core member by an adhesive, said segments projecting radially outwardly from the circumferential surface in the region of the first end of said core member and in combination with the circumferential surface forming axially extending grooves between circumferentially adjacent said segments.

4. A grinding tool according to claim 2 or 3 wherein the preformed segments are parts of a cylinder of ceramically bonded grinding material which has been divided by axial separating cuts of small widths to form said segments.

5. A grinding tool according to claim 2 or 3 wherein, starting from an end face of the core member at the first end thereof, the circumference thereof has a number of recesses wherein the segments are fixed, the radial depth of the recesses being less than the thickness of the segments.

6. A grinding tool according to claim 2 or 3 wherein the segments have a wall thickness of approximately 3 to 5 mm.

* * * * *